United States Patent [19]

Stöckl

[11] Patent Number: 4,840,429

[45] Date of Patent: Jun. 20, 1989

[54] MOTOR-ADJUSTABLE HEAD SUPPORT FOR A DENTAL TREATMENT CHAIR

[75] Inventor: Klaus Stöckl, Bensheim, Fed. Rep. of Germany

[73] Assignee: Siemens Aktiengesellschaft, Berlin and Munich, Fed. Rep. of Germany

[21] Appl. No.: 222,516

[22] Filed: Jul. 21, 1988

[30] Foreign Application Priority Data

Aug. 14, 1987 [DE] Fed. Rep. of Germany ..... 3727204

[51] Int. Cl.[4] ..... A47C 7/38

[52] U.S. Cl. ..... 297/409; 248/118; 248/281.1; 297/391

[58] Field of Search ..... 297/408, 409, 391, 361, 297/434, 436; 248/281.1, 118

[56] References Cited

U.S. PATENT DOCUMENTS

| | | | |
|---|---|---|---|
| 3,065,029 | 11/1962 | Spound et al. | 297/391 |
| 3,817,576 | 6/1974 | Ciavattoni et al. | 297/397 X |
| 4,366,985 | 1/1983 | Leffler . | |
| 4,466,663 | 8/1984 | Oishi et al. | 297/391 X |
| 4,515,406 | 5/1985 | Fujiyama . | |
| 4,720,146 | 1/1988 | Mawbey et al. | 297/409 |
| 4,733,913 | 3/1988 | Tateyama | 297/409 |

FOREIGN PATENT DOCUMENTS

| | | | |
|---|---|---|---|
| 2441506 | 3/1977 | Fed. Rep. of Germany . | |
| 2932344 | 2/1981 | Fed. Rep. of Germany . | |
| 3130780 | 3/1983 | Fed. Rep. of Germany . | |
| 3347255 | 7/1985 | Fed. Rep. of Germany . | |
| 3543980 | 6/1987 | Fed. Rep. of Germany | 297/391 |

*Primary Examiner*—Peter A. Aschenbrenner
*Assistant Examiner*—Thomas A. Rendos

[57] ABSTRACT

The invention is directed to an adjustable head support for a dental treatment chair, which is a reclining chair with an adjustable head rest or support. In order to better match the kinematics of the adjustable head support to a natural tilting motion of a patient's head, it is proposed that a quadrilateral linkage pivotally connects an upper region of the back rest to the head rest and the connection of the linkage to the head rest is shifted as the head rest tilts to cause a point on the head rest to move in an arc having a center roughly in the cervical vertebra joint of the patient lying in the chair.

17 Claims, 3 Drawing Sheets

MOTOR-ADJUSTABLE HEAD SUPPORT FOR A DENTAL TREATMENT CHAIR

BACKGROUND OF THE INVENTION

The present invention is directed to a motor-adjustable head support for a dental treatment chair. As used herein, the term "dental treatment chair" refers to a chair with a reclining capability and an adjustable head support.

Various designs have been developed in an effort to adapt a motion sequence of an adjustable head support of a dental treatment chair to a natural tilting movement of the head of a patient in various treatment positions, predominantly during treatment of a patient's upper or lower jaw while the patient is in a seated or reclined position.

U.S. Pat. No. 4,515,406 discloses a design wherein a carrier plate of a head support, which is also frequently referred to in technical jargon as a "head support sword," is a circularly curved, narrow plate having a center of a circle that lies roughly in a cervical vertebra joint of a patient sitting in a dental treatment chair. The curved plate is guided in a carriage, which is displaceable by a hydraulic drive cylinder along a back rest, and the plate can be moved into and out of the carriage by another hydraulic cylinder drive. First, guidance of the carrier plate along a circular arc and longitudinal guidance of the carriage are relatively complicated; second, a relatively thick design of the back rest is required in order to accommodate these elements, particularly an arcuate plate, inside the back rest in a retracted condition. A preferred embodiment would consist of a thinner back rest in this region in order to be able to position the head of the patient as low as possible in a fully reclined position, but still allow adequate freedom for an attendant's knees. This embodiment, however, would lead to a restriction of the kinematics and, thus, to a restriction of positioning possibilities.

German OS No. 25 41 506 discloses a design of an adaptor element for a head support which adapter has a curved path that, as viewed from the side of the head support, includes oppositely curved sections in a wave-like fashion. The curved patch has a guide arranged at the back rest, whereby the adaptor element has its end facing away from the head support and is connected to a traction or thrust mechanism arranged at the back rest in order to effect an adjustment of the head support. The guide of the curve path is formed by a horizontal rod arranged transversely relative to a longitudinal direction of the back rest with the curve path of the adaptor element resting against the horizontal rod. The horizontal rod is mounted for rotation. The adaptor element has its end facing away from the head support and is pivotably and longitudinally displaceably mounted in a carriage in the back rest with this carriage being adjusted by a another traction or thrust mechanism.

In this design, freedom of leg movement of an attendant is also restricted given a reclined treatment position.

SUMMARY OF THE INVENTION

The object of the present invention is directed to an improvement of an adjustable head support of a dental treatment chair with a goal of achieving an optimum matching between kinematics of the adjustable head support and a natural tilting motion of a patient's head in various treatment positions. Head positions during treatment of an upper or lower jaw of a seated or reclined patient require the head support to be adjustable in an optimally broad range following the natural tilting motion of a patient's head. Therefore, spatial dimensions of such an adjustment mechanism for the head support should be as small as possible.

The above objects are accomplished by an improvement in a reclining chair having a back rest, head support with a housing and adjustment means for positioning the head support relative to the back rest. The improvements comprise the adjustment means having a guideway rigidly mounted in the housing, a straight line, longitudinal moving mechanism having a fixed part receiving a moveable part being disposed in the housing, drive means for moving the moveable part along said fixed part being positioned in the housing, two supporting arms each having a pivotable first connection at one end to a second part on said back rest and having the other end being provided with a pivotable second connection to the moveable part, said second connections on the pivotable part being spaced apart by a distance greater than the distance between the first connections to form a quadrilateral linkage, and one of the two arms having a roller engaging said guideway so that when the moveable part is shifted on the first part, the head support moves on a predetermined curve having a center offset from the pivot connections and said back rest.

A critical advantage of the invention is that, due to support arms being designed in a fashion similar to a parallelogram, a tilting of the head support produces an oppositely directed tilting motion, which results in an optimum matching to the natural tilting motion of a patient's head and an extremely wide range of adjustment positions for the head support. Since all parts for generating the kinematics lie outside of a housing for the back rest and largely inside a housing for the head support, the back rest itself can be designed extremely thin since it need only include a simple, straight-line mechanism for an a extremely narrow and thin head support carrier part.

DESCRIPTION OF THE PREFFERED EMBODIMENTS

Figure 1:
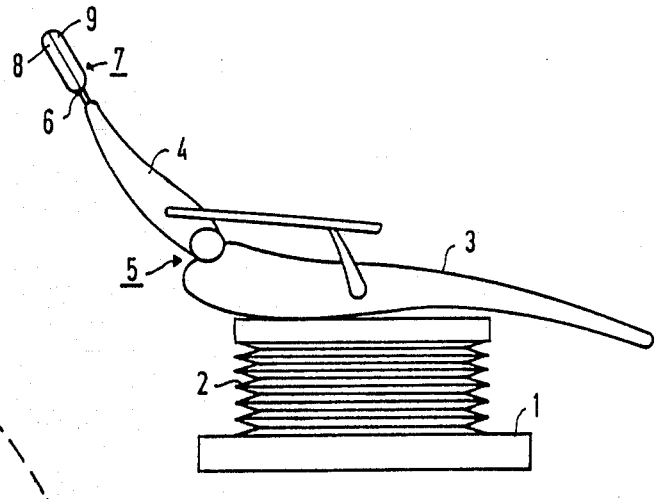
FIG. 1 is a side view of a dental treatment chair according to the present invention.

The principles of the present invention are particularily useful when incorporated in a dental treatment chair having an upper chair part 5 which is composed of a seat 3 and a back rest 4 as held in a height-adjustable fashion on a base 1 by an adjustment mechanism 2 which is held in a known way. An adjustable head support 7 is held on the back rest 4 by a carrier part 6 which allows adjustment in a longitudinal direction. The head support 7 contains two shell-shaped housing parts, a lower or back housing part 8 and an upper or front housing part 9 which is enclosed by a head support cushion.

Figure 2:
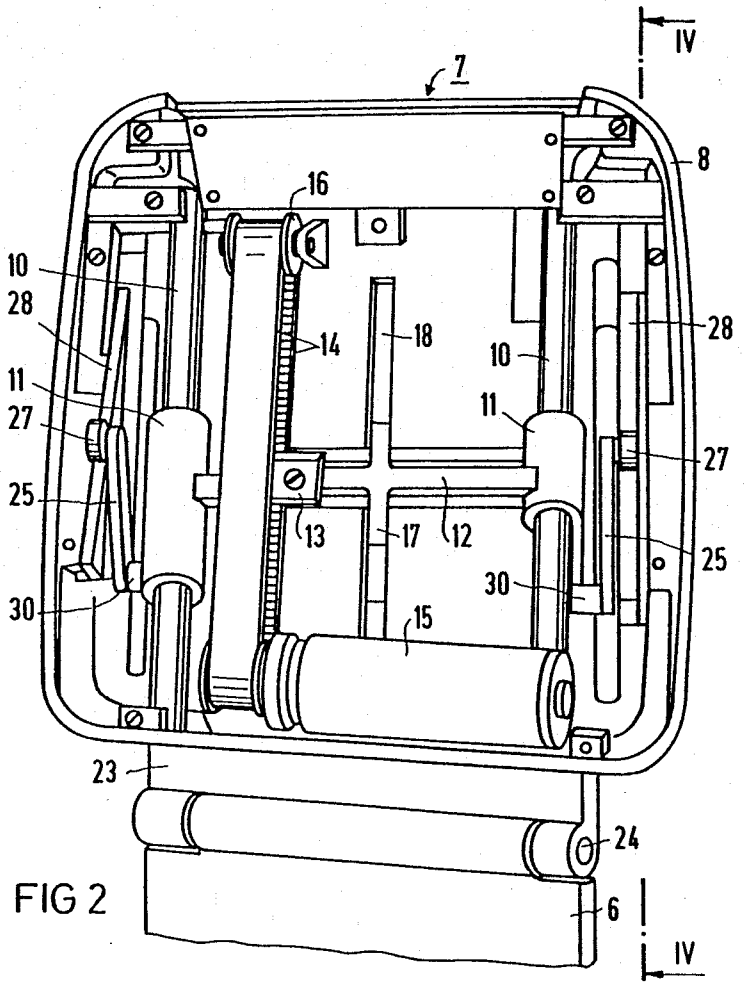
FIG. 2 is a front view of the adjustable head support of the dental treatment chair of FIG. 1 with a front half of the housing removed.

As illustrated in FIG. 2 the back housing part 8 of the head rest 7 has two guide rods 10 which extend in a longitudinal direction of the adjustable head support 7 and are rigidly secured in the housing part 8. Ball boxes or bushing 11 are guided in an adjustable fashion on the guide rods 10 and form moveable parts. The parts or ball bushing 11 rigidly connected to one another by a tie-bar 12 which is arranged transversely relative to a longitudinal axis of the adjustable head support 7. A clamp element 13 is attached to the tie-bar 12. The clamp element 13 connects the tie-bar 12 and moveable parts 11 to a toothed belt 14 which is part of an electromotive drive means that contains a motor 15, which is transversely mounted in a lower end of the head support 7, and a guide roller 16 arranged at the opposite end of the belt from the motor.

A dog 17 is rigidly secured to the middle of the tie-bar 12. The dog 17 extends through the lower housing part 8 via a opening or slot 18 that is arranged centrally relative to the head support 7. The dog 17 forms a pivotable joint 21 together with a first plate-shaped support arm 20. The first plate-shaped support arm 20 has one end lying opposite the first pivotal joint 21 forming another or second pivotal joint 22 with the carrier part 6 of the head support 7.

Figure 4:
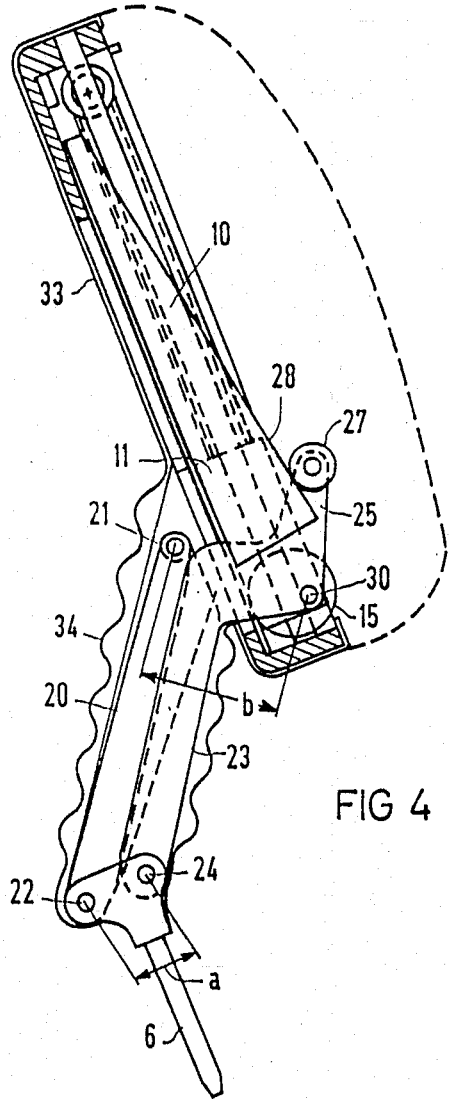
FIG. 4 is a cross sectional view taken along line IV—IV in FIG. 2.

A second plate-shaped support arm 23 roughly corresponding to the width of the head support 7 forms a third pivotal joint 24 with the carrier part 6 at one end. The second plate-shaped support arm 23 at the other or opposite end includes two narrow continuations 25 at both sides. The two continuations 25, as shown in FIG. 4, are hook-like. The two continuations 25 extend through slots 26 in the back housing part 8 of the head support 7. Carrier rollers 27 are arranged at the end of each of the two continuations 25 and engage oblique guideways 28 which are rigidly secured to the lower housing part 8 of the head support 7. The two continuations 25 and the second plate-shaped supporting arm 23 form a fourth pivotal joint 30 with the moveable parts 11 in a region of a bend location.

As shown in FIG. 4, the plate-shaped supporting arms 20, 23 and the pivotal joints 22, 24 and 21, 30 form a configuration similar to a parallelogram, but in contrast to a true parallelogram configuration in which distances between pivotal joints are equal, spacing between these pivotal joints is not equal. A spacing "b" between the upper pivotal joints 21, 30 is about twice as large as a spacing "a" between the lower pivotal joints 22, 24. A "distorted" parallelogram is thereby created and makes it possible for the head support 7 to execute an opposite swivel in a region of the head support 7 with a swivel toward the back rest 4 (see dot-dash illustration in FIG. 5). The head support 7 does not execute a pure parallelogram motion nor a pure swivel motion, but a mixed motion composed of both.

Figure 5:
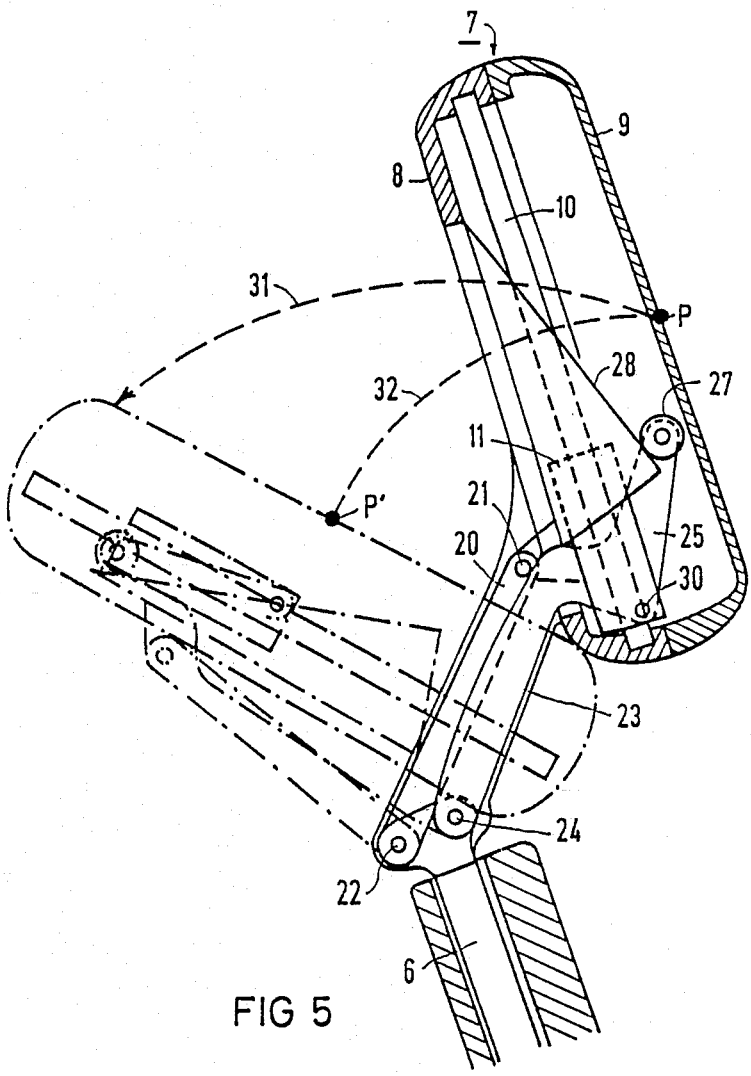
FIG 5. is a cross sectional view of the adjustable head support in two adjusted positions.

The two ball bushings 11 move on the guide rods 10 and are driven by the toothed belt 14 which is secured to the tie-bar 12. The movement of the toothed belt 14 also adjusts the plate-shaped supporting arms 20, 23 and, thus, the carrier rollers 27 which are attached to the continuations 25 of the second plate-shaped support arm 23. The carrier rollers 27 are supported against the oblique guideways 28 and their movement adjusts the head support 7 in the described way. The relationship between the swivel motion and longitudinal displacement, as illustrated by curve 32 in FIG. 5, is determined by a pitch and shape of a path established by the oblique guideways 28. The curve 32 corresponds to a circular arc whose center lies in a region of a cervical vertebra of a patient situated in the dental treatment chair. An imaginary point P of a patient—s head situated in the adjustable head support 7 does not follow a circular arc 31, but instead follows a motion illustrated by curve 32.

Figure 3:
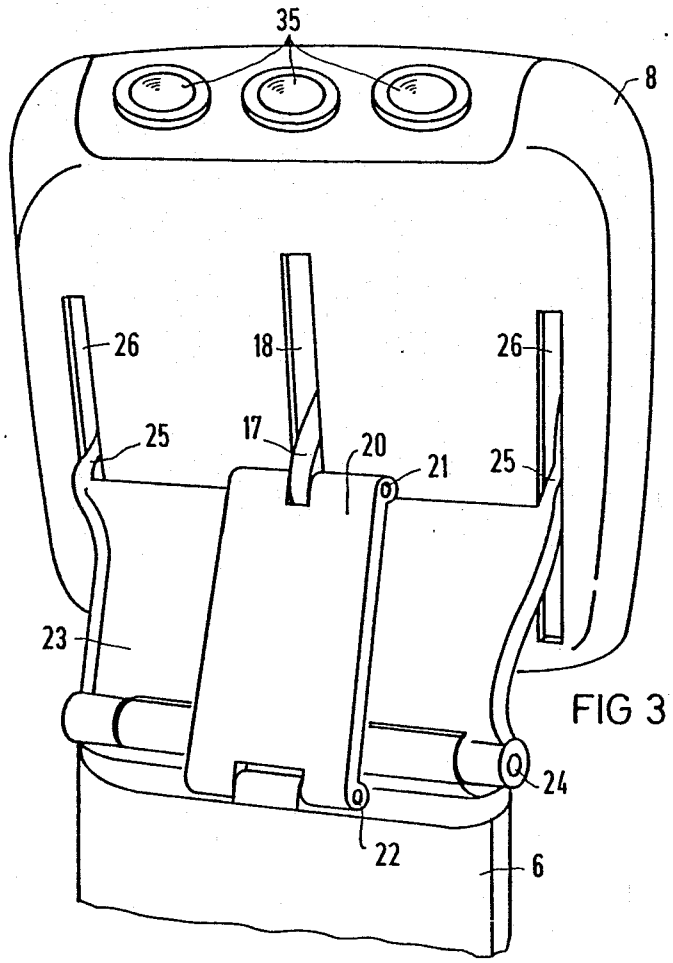
FIG. 3 is a back view of the adjustable head support.

Various modifications are possible with respect to the drive and to the plate-shaped support arms 20, 23. For example, the drive means can have a spindle drive instead of the toothed belt 14 and the plate-shaped support arms 20, 23 can be a standard lever design instead of the described, plate-shaped embodiment. The drive means can be placed in the region of the back rest 4, for example, inside the back rest 4, and adjustment can be accomplished by using a cable pull or a toothed belt. For hygienic and optical reasons, the under or back part of the head support 7 can be covered with an elastic covering 33 that includes a bellows-like projection 34 in a region of the plate-shaped supporting arms 20, 23. The elastic covering 33 can also extend over switches 35 (see FIG. 3) which are arranged at the upper side of the head support 7. The actuation elements of the switches 35 would also be enclosed by the elastic covering 33.

Although various minor modifications may be suggested by those skilled in the art, it should be understood that I wish to embody within the scope of the patent granted hereon all such modifications that reasonably and properly come within the scope of my contribution to the art.

I claim as my invention:

1. A reclining chair having a back rest, a head support with a housing and adjustment means for positioning the head support relative to the back rest, said adjustment means having a guideway rigidly mounted in the housing, a straight-line moving mechanism having a fixed part receiving a movable part, said mechanism being disposed in said housing, drive means being positioned in the housing for moving the movable part along said fixed part, two supporting arms each having a first pivotable connection at one end to a second part on said back rest and at the other end having a second pivotable connection to the movable part, said second pivotable connections on the movable part being spaced apart by a distance greater than a distance between the first pivotable connections to form a quadrilateral linkage and one of the two arms having a roller engaging said guideway so that when the movable part is shifted on the fixed part, a point on the head support moves in a predetermined curve having a center offset from the pivotable connections and said back rest.

2. A reclining chair according to claim 1, wherein said second part is fixed to the back rest of said chair.

3. A reclining chair according to claim 1, wherein said second part is a carrier element attached to the back rest in a longitudinal direction of said chair.

4. A reclining chair according to claim 1, wherein said one arm has an angled continuation that extends through a corresponding slot in the housing, said roller being arranged at the free end of said continuation, and said guideway forming an oblique plane which is engaged by said roller.

5. A reclining chair according to claim 1, wherein the other supporting arm has a plate shape and is hinged to a dog with said second pivotable connection with said dog extending out through a slot in the housing, said slot being arranged at half the head support width, said dog being rigidly connected to said movable part of said straight-line moving mechanism.

6. A reclining chair according to claim 5, wherein said fixed part is formed by two parallel guide rods enclosed in the housing and said movable part is two guide brushes embracing said two guide rods.

7. A reclining chair according to claim 6, wherein said two guide brushes are rigidly connected to one another by a tie-bar which extends transversely relative to a longitudinal axis of said adjustable head support, and said dog is rigidly connected to said tie-bar.

8. A reclining chair according to claim 6, wherein said drive means includes an electric motor, a transmission element connected to the motor and arranged in the housing between said two guide rods, and a clamp element connecting said transmission element to said movable part.

9. A reclining chair according to claim 8, wherein said transmission element is a toothed belt.

10. A reclining chair according to claim 1, wherein the housing of the head support is formed by two half-shells, one supporting the adjustment means and another supporting a cushion of the adjustable head support.

11. A reclining chair according to claim 1, wherein said supporting arms have an elastic covering.

12. A reclining chair according to claim 11, wherein an entire back part of said adjustable head support has an elastic covering.

13. A reclining chair according to claim 11, wherein said elastic covering has a bellows-like projection in a region of said supporting arms.

14. A reclining chair according to claim 11, wherein said elastic covering encases switches arranged in a region of said ajustable head support.

15. A reclining chair according to claim 14, wherein said switches controls actuation of said drive means.

16. A reclining chair according to claim 1, wherein the reclining chair is a reclining dental treatment chair.

17. A reclining chair according to claim 1, wherein said housing has a pair of spaced apart slots, said guideway being disposed adjacent one of said pair of slots and another guideway being disposed adjacent the other of said pair of slots, each of said guideways forming an oblique plane, said one supporting arm having a width to extend over nearly the entire width of said adjustable head support and having a pair of sides, said one arm having a projection adjacent each of the pair of sides to form a pair of angled continuations that extend through said pair of slots in the housing, said roller being arranged at the free end of one of the pair of continuations, and another roller being at the free end of said other of said pair of continuations, said rollers engaging said oblique planes of the guideways.

* * * * *